United States Patent [19]

Ripley

[11] Patent Number: 4,909,417

[45] Date of Patent: Mar. 20, 1990

[54] CAP BASE DISPENSING APPARATUS

[76] Inventor: Wayne H. Ripley, P.O. Box 2666, San Angelo, Tex. 76902

[21] Appl. No.: 248,499

[22] Filed: Sep. 23, 1988

Related U.S. Application Data

[63] Continuation-in-part of Ser. No. 086,544, Aug. 18, 1987, abandoned.

[51] Int. Cl.[4] ..... B67D 3/00

[52] U.S. Cl. ..... 222/145; 222/185

[58] Field of Search ..... 222/67, 129.1–129.4, 222/145, 146.6, 481.5, 485, 185, 57

[56] References Cited

U.S. PATENT DOCUMENTS

| | | | |
|---|---|---|---|
| 1,207,278 | 12/1916 | Cordley | 222/131 |
| 3,655,097 | 4/1972 | Booth et al. | 222/129.4 |
| 4,386,718 | 6/1983 | Stewart et al. | 222/185 |
| 4,564,126 | 1/1986 | Adolfsson | 222/61 |
| 4,715,516 | 12/1987 | Salvail | 222/153 |
| 4,773,561 | 9/1988 | Sedam | 222/129.1 |

FOREIGN PATENT DOCUMENTS

| | | | |
|---|---|---|---|
| 175815 | 2/1986 | European Pat. Off. | 222/129.1 |

*Primary Examiner*—Michael S. Huppert

*Attorney, Agent, or Firm*—Wayne H. Ripley

[57] ABSTRACT

A liquid dispenser for an inverted rigid container is provided for mixing flavored syrups with water and carbon dioxide gas from a remote pressure controlled equalizer float valve reservoir in conjunction with an inverted base container for diffusing carbonated water into an inner top for full carbonation. Liquids are cooled by an ice tub funneled upwardly from a top or the base providing an ice channel around dispenser container. A threaded socket is connected by a toggle wing, stabilizing clamp to a stable platform base for a combination of cooling coils, air intake two-way valve extending up from base portion that is inserted into the neck of the opening of an original or other container. The threaded socket provides a seal and provides an opening to discharge the liquids. Mixing faucets control the flow of carbonated or other liquids in conjunction with base container.

3 Claims, 3 Drawing Sheets

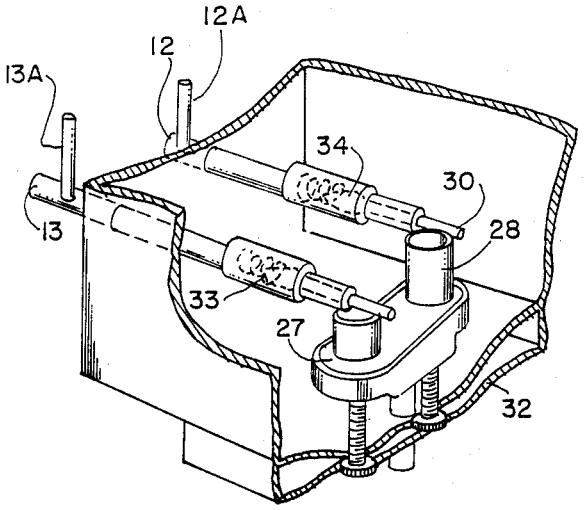
FIG. 3
FIG. 2
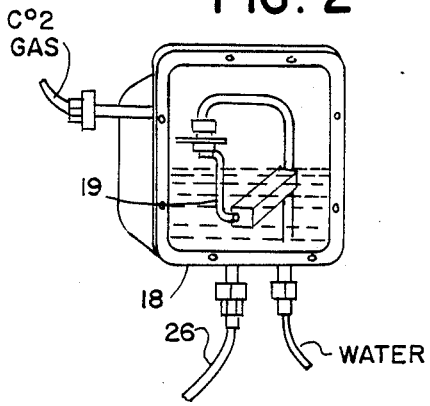
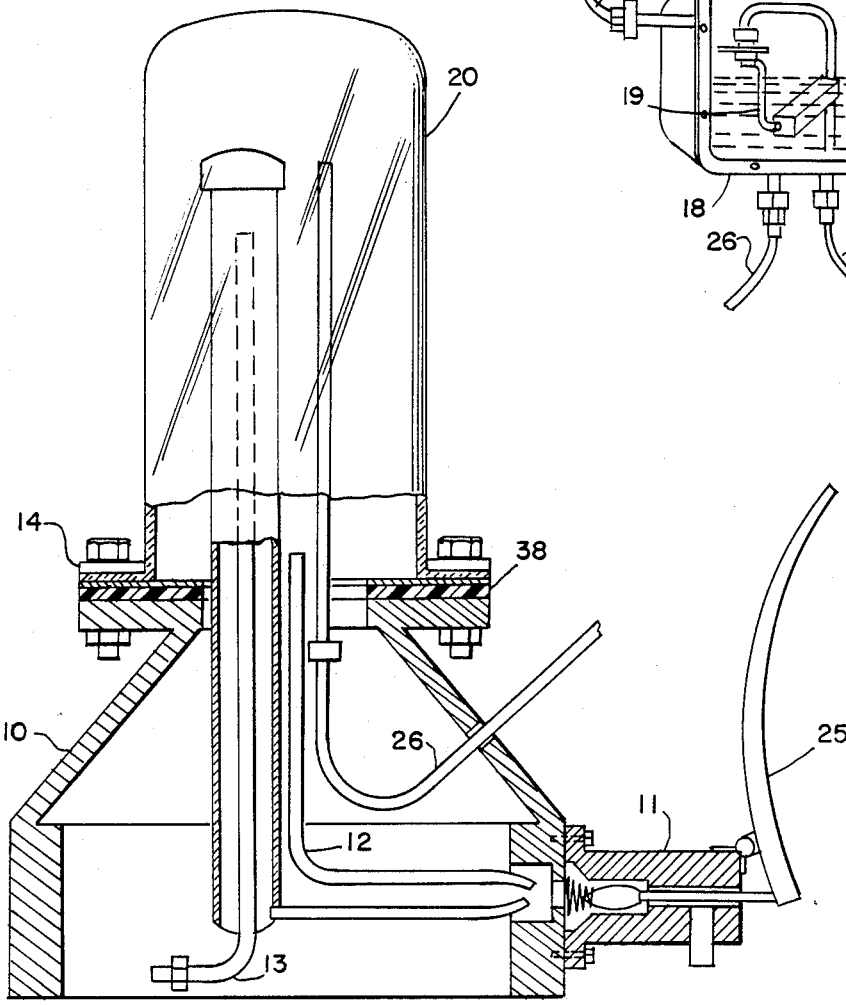
FIG. 1

CAP BASE DISPENSING APPARATUS

This is a continuation in part of application Ser. No. 086,544, filed Aug. 18, 1987, now abandoned.

CROSS-REFERENCE

Sanderson U.S. Pat. No. 4,646,944 will not carbonate a liquid or cool the liquid or mix two liquids, or vent the container. Mine will.

The Walter U.S. Pat. No. 4,186,848 will not carbonate a liquid, or cool the liquid. A hot carbonated beverage can have a pressure of 50 pounds or over and this vent outlet will not hold this beverage. My dispenser will.

Stewart U.S. Pat. No. 4,386,718 cannot mix liquids and his air bleed valve lets any overflow out of his container dump on the table top. Mine will not.

S. Pinanski U.S. Pat. 2,514,558 will not mix, make or cool, and air vent dispense liquids not for cooling. His envelop has a nut for cooling. My dispenser will do more than his.

Henry G. Coudley U.S. Pat. No. 1,207,287 cannot mix two liquids nor hold a carbonated pressure beverage. His vent tube would let the $CO^2$ gas blow out when the spigot was opened. Mine can hold the $CO^2$.

C. G. Reynaud U.S. Pat. No. 3,042,267 has a clamp closure that would be hard to fit with no vent valve to hold pressure in the container. It cannot mix two liquids and the spigot will not hold a carbonated pressure, just a gravity flow. Mine will do more than this.

BACKGROUND OF THE INVENTION

This invention relates generally to drink dispensers, more particularly to a dispensing device for making carbonated beverages.

In recent times there has been a trend in the sale of post-mix beverages. A carbonated beverage is made of carbonated water to which there is mixed a juice or syrup, requiring good water, the proper level of carbonation, and the proper proportion of mix between the syrup and carbonated water. While these prior units have proved satisfactory in the past, they are relatively complicated and, among other things, they require electric refrigeration or waterpumps which are costly to maintain. Thus, there is a need for a simple, low-cost dispensing system which can mix carbon dioxide gas and water and easily dispense carbonated beverages.

SUMMARY OF THE INVENTION

My invention contains all of the elements necessary in a carbonated drink dispenser without the use of electricity and, in accordance with the invention, the carbonator is capable of being removed and used with a number of alternate dispensers. This is possible for use with the present invention. However, where the dispenser is a stored-alone unit, which normally will be the case, it must be periodically batch refilled with ice tub cooling liquid. My simple post-mix dispenser can be used with alternate dispensing valves including electric valves by others. Another object of my invention is to provide cooling carbonated water within the base container with interior liquid cooling coils emerging upwardly in the carbonated water and communicating with discharge mixing faucet, said vent tube having an air valve located at the end thereof for venting and receiving remote liquids. A feed tube connects said base container with a remote rigid mixing reservoir containing water and carbon dioxide gas, said reservoir with a fresh water float-control valve, will determine the amount of carbonated water in the remote rigid mixing reservoir whereby the resulting carbonated water flows via said feed tube through base and ice tub to interior top portion of the inverted base container. The container is filled with carbonated water to a regulated level and controlled by the fresh water float control valve controlling the levels in the base container and the remote rigid mixing reservoir. As carbonated water is diffused above cold carbonated water in the base container in the carbon dioxide gas portion, it further mixes and carbonates as it falls down for communicating with said discharge mixing faucets to allow selective dispensing of either one of the liquids from base container and cooling coils, such as carbonated water being the center long handle. Selective individual liquids such as syrup handles, being shorter, step-down handles, go next to the center water-only handle and the outside syrup handles and center water handle are the same in length, having means of attached levers to each side handle. Lower front and upper back will not pull open without pulling the carbonated water handle open. This provides a mixed flavored beverage being discharged through faucets and the mixing cavity nozzle plate into a cup.

BRIEF DESCRIPTION OF THE DRAWINGS

FIG. 1 is a partially sectioned side view of the dispenser showing the carbonator section FIG. 2 is a sectional view of the remote rigid mixing reservoir with a fresh water float control valve carbon dioxide gas communicate with FIG. 1

FIG. 3 is a sectional view of the discharge mixing faucet and mixing nozzle with the handles partially cut away showing an alternative arrangement

DESCRIPTION OF THE PREFERRED EMBODIMENT

Figure 4:
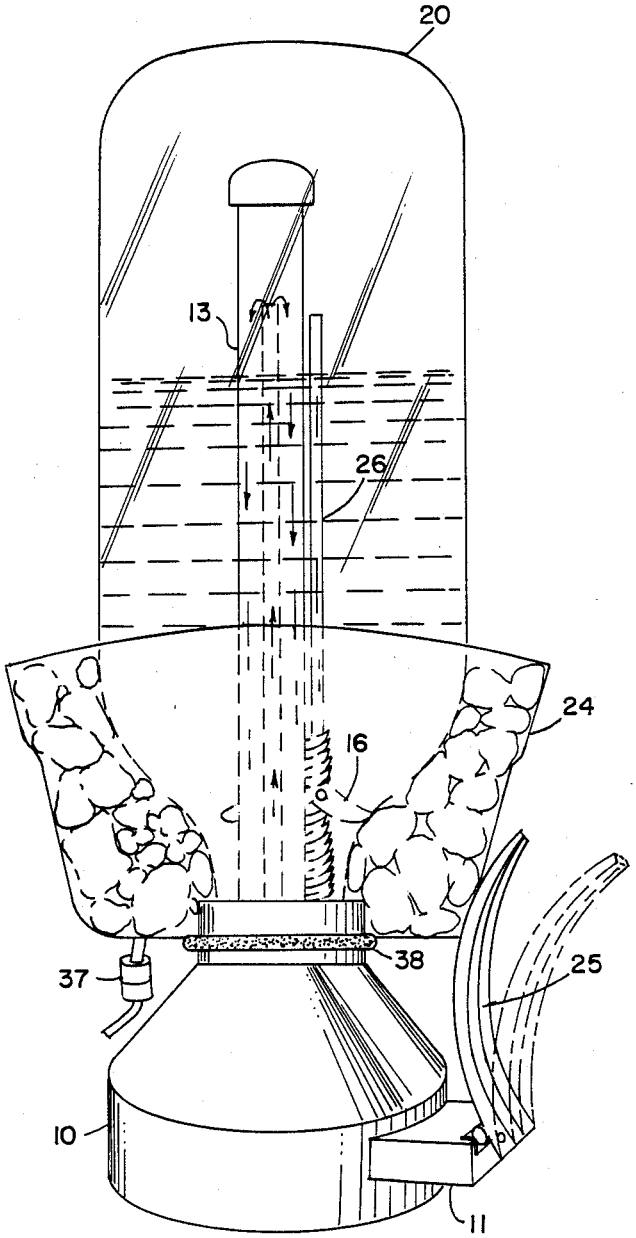
FIG. 4 is a perspective view of post-mix dispenser of an alternative embodiment with ice tub and cooling tub and toggle wing clamp communicating with FIG. 2

The subject invention may be designed and constructed in various ways but is exemplified now in the drawing which includes a liquid dispensing apparatus in FIGS. 1–3 and comprises a mounting base 10 which includes an inverted liquid container 20, a coupling means 9-16-14, and a remote water and carbon dioxide gas mixing FIG. 3. Reservoir 18 located in the mounting base 10 centrally located in said base coupling means includes surrounded bolts around flange 14 of the open end of rigid container 20 to base flat rigid top of base 10 and provides a press-fit, secure seal 38 with the liquid container. 20. Another alternative, a threaded and toggle wing clamp 16 being inserted into the open neck end of the liquid container 20 is surrounded by a threaded collar 9 and base 10 making a press-fit secure seal with the liquid container 20 and the base 10 additional coupling means releasably attaching an ice tub 24 surrounding liquid container 20 for holding ice and cooling liquids in said container providing a press-fit secure seal with base 10 and container 20. A discharge melted ice water tube 37 in lower bottom of ice tub 24, cold water flows into base drain pan in bottom of base 10 not shown. An incoming flow tube 13 into a larger cooling tube coil extending upwardly from said base 10 through ice tube 24 to the interior top portion of said container 20 cooling a smaller amount of post-mix syrups and juices. As liquid flows through tube 13 immersed in carbonated water in container 20, cooling the flow of liquid to lower bottom of larger tube, to smaller tube 13 and communicating with said discharge mixing faucet 11, a feed tube 26 connects said container 20 with a remote rigid mixing reservoir 18 containing water and carbon dioxide gas. Said reservoir 18 is provided with a fresh water float control valve 19. FIG. 3 mixed water and carbon dioxide as pressure force flows carbonated water through tube 26 to inner top portion of container 20 for diffusion into full carbonation when carbonated water or liquids are discharged from container 20 through tube 12 to discharge mixing faucet 11. When pressure has fallen below the pressure in remote rigid mixing reservoir 18, the higher pressure force flows carbonated water through tube 26, replacing the amount discharged from container 20.

Figure 5:
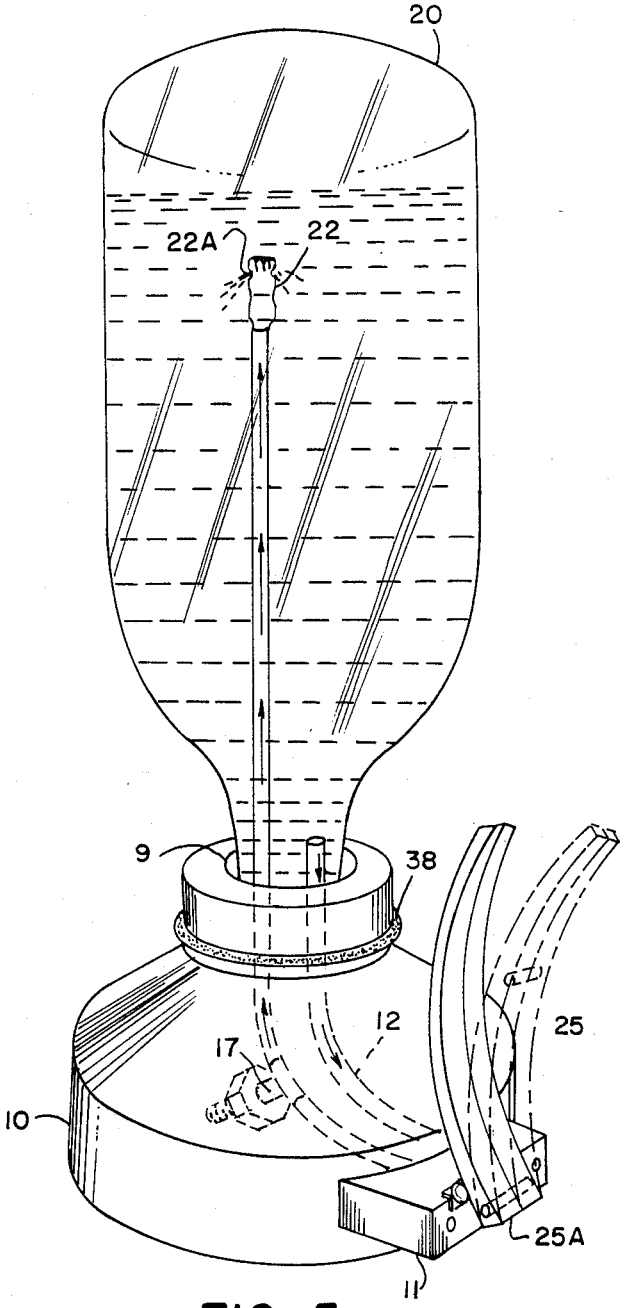
FIG. 5 is a modified dispenser for receiving remote liquids such as pre-mix and juice through vent air valve tube
Figure 6:
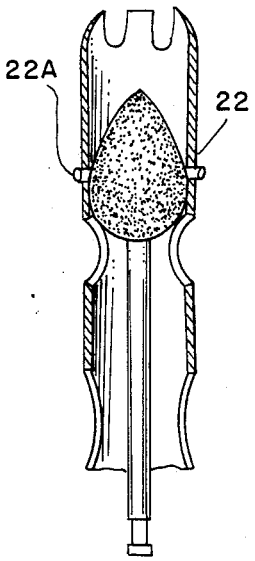
FIG. 6 is a two-way incoming air venting valve communicating with the vent tube in FIG. 5

FIGS. 5–6 With modification for receiving remote pre-mix carbonated or juice beverages through tube 17 joined to cooling coil and having an air vent valve 22 located at the upper end thereof for receiving liquid flow from tube 17, valve seat will open keeping container 20A full through orifice 22A for cooling venting for a pressure or non-pressure beverage and communicating with container 20, discharge tube 17, faucet 11, and discharge tube 12 in lower bottom of container 20 flowing through tube 12 to discharge faucet 11. FIG. 4 illustrates the manner in which the respective discharge mixing faucet 11 is coupled to base portion 10 and the post-mix beverage dispenser faucet includes the reception of syrup having the desired flavor, a second inlet tube 12 for the reception of a suitable dilutent in the specific instance is carbonated water as shown in FIG. 4. The inlet tube fittings 12A and 13A are received by counterbores 27 and 28 within the body and extend through the body 11 to opening 27 and 28. As clearly shown in FIG. 4, the bores 27 and 28 become much smaller diameters than the inlet chambers 12 and 13; thus, faucet seats 33 and 34 are formed in the bore into their respective inlet. Faucet members 30 and 31 are disposed in the inlet chamber 27 and 28 and are selectively movable into and out of contact with the respective faucet seats. In order to regulate the flow of liquids within the bore 27 and 28, the faucet member valve stems 30 and 31 are comprised of a resilient material such as synthetic rubber or the like and compression springs giving excellent seals against the faucet seats 33 and 34 inlet fittings 12A and 13A as best shown in FIG. 4. The bores 27 and 28 turn downwardly with liquids flowing into the cavity mixing nozzle plate 32 with flow control threaded stems at each discharge outlet 27A controlling the amount of syrup having the desired flavor. A second outlet 28A for a suitable dilutent, which in this specific instance is carbonated water discharging syrup and water into a releasable attached cavity mixing nozzle plate 32, discharging a mixed beverage through one opening with valve seat stems extending through the body 11 bores 27 and 28 to outer front of body 11. A series of pull handles 25 and 25A with a through pin attached to body 11 top front pivots to contact the end of valve stem 30, and when handle 25 is pulled outward it will press open valve stem seat 34 to allow carbonated water only through. The bore 28 communicates with the inlet tube 12 flowing from container 20. A second pull handle 25A next to and a part of pull handle 25 by means of a lever attached to handle 25A on lower front and upper back side presses open handle 25 and 25A simultaneously, pressing open valve stem 31 and opening valve seat 33 to allow the flow of syrup through 27 flowing from cooling coil 13 from interior of container 20 allowing selection of one or more flavored beverages mixed and dispensed through one nozzle 32. Up to five fluids such as syrup and water dilutents can be used. An alternative means of up to five pull handles can be used, center handle 25 being carbonated water and shorter handle 25A and 25B next to center handle 25 outside handle 25C and handle 25D same in length. Each syrup handle bumps open center handle 25 by having attached levers.

I claim:

1. A liquid dispensing apparatus for use in combination with an inverted container, said apparatus comprising: a base portion, a mounting base centrally located in said base portion, coupling means attached to and extending up from said base portion, said coupling means having a toggle clamp surrounded by a threaded collar, wherein said toggle clamp is inserted into the neck of the liquid container to provide the base portion with a threaded and toggle wing press-fit seal with the liquid container; additional coupling means releasably attaching an ice tub to said base portion for holding ice and cooling liquids within said container; a discharge mixing faucet communicating with said container by means of a liquid discharge tube, one end of said discharge tube being operatively coupled to the faucet and the other end of said discharge tube extending into said container neck;

at least one liquid cooling tube and a fluid inlet tube extending upwardly from said base portion into said container, said liquid cooling tube being operatively connected to said faucet; said liquid inlet tube having a valve which is located at an upper portion of said inverted container; said liquid inlet tube fluidly connecting said container with a remote rigid mixing reservoir for mixing water and carbon dioxide gas, said reservoir being provided with a fresh water float control valve; whereby the resulting carbonated water flows via said liquid inlet tube through said ice tub to an interior top portion of said container in response to operation of said faucet.

2. A liquid dispenser according to claim 1, wherein carbonated water is delivered to the container from the mixing reservoir solely by means of a pressure differential between said reservoir and said container, said pressure differential being created when said faucet is operated to discharge liquid from said container.

3. A liquid dispenser according to claim 2, wherein said at least one liquid cooling tube fluidly coupling said faucet with a source of flavoring syrup or juice concentrate, whereby operation of said faucet results in discharge of a post-mix beverage.

* * * * *